US007063728B2

(12) United States Patent
Sundar et al.

(10) Patent No.: US 7,063,728 B2
(45) Date of Patent: Jun. 20, 2006

(54) PROCESS FOR MAKING CHROME TANNED LEATHERS

(75) Inventors: Victor John Sundar, Chennai (IN); Chellapp Muralidharan, Chennai (IN)

(73) Assignee: Council of Scientific & Industrial Research, New Delhi (IN)

( * ) Notice: Subject to any disclaimer, the term of this patent is extended or adjusted under 35 U.S.C. 154(b) by 46 days.

(21) Appl. No.: 10/377,206

(22) Filed: Feb. 28, 2003

(65) Prior Publication Data

US 2004/0031106 A1 Feb. 19, 2004

(51) Int. Cl.
*C14C 3/06* (2006.01)

(52) U.S. Cl. ..... 8/94.26; 8/94.27

(58) Field of Classification Search ..... 8/94.26, 8/115.51, 94.27
See application file for complete search history.

(56) References Cited

U.S. PATENT DOCUMENTS 4,126,413 A * 11/1978 Traubel et al. ..... 8/94.26

* cited by examiner

*Primary Examiner*—Yogendra N. Gupta
*Assistant Examiner*—Preeti Kumar
(74) *Attorney, Agent, or Firm*—Merchant & Gould P.C.

(57) ABSTRACT

The present invention provides an improved pickling and bating free process suitable for both hides and skins for making chrome tanned leathers by using a mixture of conventional chrome tanning salt and alkali metal salt is used at a pH in the range of 5–5.5.

5 Claims, No Drawings

PROCESS FOR MAKING CHROME TANNED LEATHERS

This application claiming priority from Indian Patent application No 177 DEL 2002 filed on Feb. 28, 2002.

FIELD OF THE INVENTION

The present invention relates to an improved process for making chrome tanned leathers. This process methodology is envisaged to have tremendous application potential in the tanning industry, not only for improved chromium uptake during tanning, but also for substantial reduction of total dissolved solids in the waste streams.

BACKGROUND AND PRIOR ART REFERENCES

Salted hides and skins are the major raw materials for the tanning industry. In leather making process, the first operation carried out is removal of the salt in the hides and skins through repeated washings. The hair and flesh are loosened by treatment with lime and sodium sulfide and then removed using knives. The hides and skins are then agitated with acid salts like ammonium chloride for removal of residual lime. The operation is called deliming, which is usually carried out in tanning drum. The resulting delimed hide and skins are subjected to pickling using 10% salt (all percentages mentioned are on the basis of weight of hides and skins) and 1% mineral acid in the hitherto known process, basically to condition the material prior to chrome tanning which is usually carried out by treatment with basic chromium sulfate (BCS). In other words, pH of the delimed stock, which is around 8.0 is brought down to 2.8 to 3.0 during pickling to facilitate uptake as well as penetration of chrome in the cross section of the stock to be tanned. While the penetration of BCS in hides and skins during chrome tanning is carried out at a pH 2.8 to 3.0 the same is raised to 3.8 to 4.0 for fixation, which is known as basification in the industry. Alkaline salts of weak organic acids which are normally referred to as masking salts are added during chrome tanning process to prevent surface fixation of chromium in hides and skins.

The major limitation associated with the conventional chrome tanning process is the generation of effluents with significant quantities of total dissolved solids and chromium. In fact pickling and chrome tanning contribute significantly for total dissolved solids in the effluent during chrome tanning. Presence of large quantities of total dissolved solids in effluent makes the treatment of tannery effluents a cost ineffective proposal. Till now, no viable and cost effective solution is available for secured treatment of total dissolved solids. Minimising or eliminating the problem of total dissolved solids has been a topic of research interest for quite sometime. U.S. Pat. No. 4,484,925 deals with the treatment of leathers using non-soluble basic metallic salts with or without conventional mineral tanning salts in order to impart mycostatic, antimycotic and anti fungal properties to the leathers. Whereas, the present invention deals with elimination of a process step, pickling in the conventional mineral tanning, without any change in characteristics of the final leathers Another U.S. Pat. No. 4,622,156 deals with the treatment of pickled skins and hides with chromium tanning agent using alumina hydrate as chromium fixing agent by different approaches, while the present invention deals with elimination of pickling itself and execution of tanning at deliming stage itself.

One more U.S. Pat. No. 5,505,708 relates to a process for the preparation of tanned hides using metals other than chromium and to compound to such process. The patent deals with non-chrome tanning method. However, it mentions that metallic salt can be chosen from chromium, aluminium, titanium and zirconium. In addition, use of metallic salts other than aluminium is not substantiated through examples. In the present invention, the methodology adapted was to control the hydrolysis of chromium using salts of alkaline metals. The present invention has overcome the limitations of hitherto known pickle free systems and approach is different. The present invention claims a use of conventional chrome tanning salt and alkali metal salts eliminating a polluting step in process to produce chrome tanned leathers.

Gupta et al. (Journal of Indian Leather Technologists Association, 41, 24–26, 1992) developed a pickle free alum—chrome combination tanning system using only 2% of salt thereby reducing use of salt to an extent of 8%. However, use of aluminium in the system impairs the feel and softness of the leathers. Further, the addition of salt is not eliminated completely but is reduced. A low salt pickling system has been reported by Sridharnath et al (Leather Research and Industry Get-together Poster Session, CLRI 2001) which again pertains to use of 2% salt based pickling. The low salt pickling system has been found to be suitable for skins predominantly and again does not eliminate use of salt completely. The strength characteristics of the leathers were found to be adversely affected when salt was eliminated completely. An improved product-process for cleaner chrome tanning in leather processing has been developed by Suresh et al (Journal of Cleaner Production, 9, 483–491, 2001) where in the conventional pickling is dispensed with and use of a synthetic chrome tanning agent instead of BCS is resorted to. The pH of the process was maintained between 4.0The major limitation of the system is that it is applicable for skins only and the system calls for post tanning modification in processes.

The present invention relates to a modified process of subjecting the delimed hides or skins to chrome tanning under certain conditions, as disclosed herein below, to facilitate avoiding conventional salt, thereby overcoming the problem of total dissolved solids (TDS), which has lately been a burning issue in the leather industry.

The definitions of certain terms used in the present specifications, which are normally used in the leather industry, are given below.

Bating: The process prior to tanning proper where the fibres of a hide or skin which have been plumped or swollen by liming are reduced and softened, thus assuring pliability in the product. The word is a form of "abate" in the sense of reduce.

Beamhouse: The area of the tannery where the unhairing and liming processes are carried out. Before modern machinery the processes of fleshing, scudding and others were carried out over specially designed wooden beams using curved two handled knives with sharp or blunted edge according to the operation. Hence the name.

Deliming: A process preparatory to tanning proper to reduce the swollen and rigid fibres of a hide or skin after liming.

Drums: The collective term for the rotary vessel in which many processes of tanning are now carried out.

Side Leather: Half a hide cut along the backbone. Large hides are cut in half down the backbone to make them easier to handle in the tannery. Each piece is called a side. Most shoe leather made from cattle hides is produced as side leather, while most upholstery leather produced from hides is processed as whole hides. Increasingly the cutting of hides into sides is done after tanning, at the wet blue stage.

Pickling: A preliminary process for preparing hides and skins for tanning, largely by adjusting the pH with acid and controlling the swelling with salt. It is also use as stable way of holding material, after unhairing, for transport between plants and countries and for trading.

Liming: A process preliminary to tanning, which serves one or both of two purposes: (1) to loosen the hair or wool on a hide or skin, preparatory to dehairing; and (2) to plump or swell the fibres as of the processes necessary to prepare the substance for the action of the tan liquors. Liming is always required for the latter of these purposes.

OBJECTS OF THE INVENTION

The main objective of the present invention is to provide an improved process for making chrome tanned leathers, which obviates the limitations as stated above Another objective of the present invention is to provide a process for chrome tanning without resorting to pickling.

Yet another objective of the present invention is to provide a process applicable to both hides and skins.

Still another object of the invention is to provide which can eliminate salt completely.

SUMMARY OF THE INVENTION

Accordingly, the present invention provides an improved pickling and bating free tanning process for making chrome tanned leathers, said process comprising conditioning delimed hides or skins to a pH in the range of 5–5.5, treating the delimed hides or skins with 6–8% w/w of a mixture of basic chromium sulfate of basicity ranging 30–45% and alkali metal salt of organic acid, adjusting pH to the range of 4–4.2 by using an alkalinizing agent, and washing the tanned leather with water to get chrome tanned leather.

DETAILED DESCRIPTION OF THE INVENTION

In accordance to the objectives, the present invention provides an improved pickling and bating free tanning process for making chrome tanned leathers, said process comprising the steps of:

a) conditioning delimed hides or skins to a pH in the range of 5–5.5;

b) treating the above delimed hides or skins with 6–8% w/w, of a mixture of basic chromium sulfate of basicity ranging 30–45% and alkali metal salt of organic acid up to three carbon chain, for a period of at least 2 Hrs c) adjusting pH of the contents of step (b) in the range of 4–4.2 by alkalinizing agent, and d) washing the tanned leather with water to get chrome tanned leather.

In an embodiment, the present invention provides an improved process in which the conditioning is carried out by treating the hides or skins with acid selected from lactic acid, acetic acid and formic acid.

Another embodiment, the basic chromium sulphate used is of basicity 33.3%.

Still another embodiment, the proportion of alkali metal salt of organic acid and basic chromium sulphate used is in the range of 1:7 to 1:10.

Still another embodiment, the alkali metal salt of organic acid used is selected from sodium formate, sodium acetate, sodium citrate, sodium carbonate, potassium formate, and potassium acetate.

The basic chromium sulphate used is of 33.3% basicity, which is commercially available.

BCS is prepared by reducing dichromate using glucose or Sulphur dioxide in acidic medium and adjusting the 3.0–3.2.

Typical composition of BCS is given below;

| | |
|---|---|
| Chromium as chromium oxide % mass: | 23–25% |
| % basicity: | 30–35 |
| pH of aqueous solution: | 2.8–3.2 |

The basicity of the chrome liquor is defined as the percentage valance of chromium attached to hydroxyl group. The basicity of chrome liquor can be increased by the addition of alkali or any other substance, which reacts with acid and for lowering acids, should be added. Conventionally for tanning purposes, BCS with basicity 30–45% is used. The basic chromium salt with the above characteristics is the principal tanning agent of the global leather industry.

The process is described below in detail.

The delimed hides or skins are conditioned to a pH in the range of 5–5.5 by conventional method. Alkali metal salt of organic acid having carbon chain of length not more than three is mixed with basic chromium sulfate of 33.3% basicity in a ratio in the range of 1:7 to 1:10 and the conditioned hides or skins are treated with 6–8% of this mixture under agitation for a period not less than 2 Hrs without addition of water, when the tanning salt penetrates the cross section of the hides or skins under processing producing blue colouration at the cross section. The pH is then adjusted in the range of 4–4.2 by adding conventional alkaline solution to produce chrome-tanned leather.

The novelty and non-obviousness of the present invention lies in treating hides and skins under processing at a pH the range of 5–5.5 with basic chromium sulfate along with alkali metal salt of organic acid without addition of water, thereby facilitating penetration of chrome in the leather while avoiding the conventional pickling operation, thus ensuring an eco-friendly option for producing chrome tanned leather.

The following flow chart describe about conventional leather processing:

Step 1: Beam House Process

Fresh Hides or skins→Fleshing→Washing→Liming→lime fresh pelts

Step 2: Tanning process

Deliming→Bating→Pickling→Chrome tanning→

Step 3: Crusting Process

Splitting→Shaving→Retanning→Samming→Drying→Softening

Step 4: Finishing

Finishing

Our present invention is related to tanning process which is explained below:

Deliming→Chrome tanning

The invention is described in detail with reference to the examples given below which should not however be construed to limit the scope of the present invention.

EXAMPLE 1

12 delimed goatskins weighing 10 kilos were taken in a drum. 30 gms of formic acid dissolved in 300 ml. of water was added to drum and the skins were agitated for a period of 20 minutes to attain a pH of 5.5. The skins were then agitated with 420 gms of basic chromium sulfate and 60 gms of sodium formate for a period of 2 hours. The cross section of the skin was checked and found to be blue in color indicating complete penetration of chromium. The pH of the skins were then adjusted to 4.2 using 80 gms of sodium formate dissolved in 4 L of water, added to the drum, where in the skins were agitated continuously, in 16 equal installments over a period of eighty minutes. The leathers were then washed in plain water to get chrome-tanned leathers, which were unloaded from drum and piled.

EXAMPLE 2

10 delimed sheep skins weighing 8 kilos were taken in a drum. 24 gms of acetic acid dissolved in 240 ml of water was then added to drum and the skins were agitated for a period of 15 minutes to attain a pH of 5.3. The skins were then agitated with 640 gms of basic chromium sulfate and 64 gms of sodium acetate for a period of 2 hours. The cross section of the skin was checked and found to be blue in color indicating complete penetration of chromium. The pH of the skins were adjusted to 4.0 using 64 gms of sodium formate dissolved in 3.2 L of water, added to the drum in 8 equal installments over a period of 80 minutes. The leathers were washed in plain water to get chrome-tanned leathers, which were unloaded from drum and piled.

EXAMPLE 3

10 delimed cow sides weighing 50 kilos were taken in a drum. 250 gms of lactic acid dissolved in 2.5 L of water was then added to the drum and the sides were agitated for a period of 25 minutes to attain a pH of 5.2. The sides were then agitated with 3.2 kgs. of basic chromium sulfate and 400 gms of sodium formate for a period of 2½ hours. The cross-section of the sides were checked and found to be blue in color indicating complete penetration of chromium. The pH of the sides were adjusted to 4.1 using 400 gms of sodium bicarbonate dissolved in 20 L of water, added to the drum in 10 equal installments over a period of 100 minutes. The leathers were washed in plain water to get chrome-tanned leathers, which were unloaded from drum and piled.

EXAMPLE 4

20 delimed buffalo sides weighing 200 kilos were drummed with 1 kg. of lactic acid dissolved in 10 L of water for a period of 30 minutes to attain a pH of 5.0. The skins were then drummed with 14.4 kgs of basic chromium sulfate and 1.6 kgs of sodium formate for a period of 3 hours. The cross-section of the sides were checked and found to be blue in color indicating complete penetration of chromium. The pH of the sides were adjusted to 4.2 using 800 gms of sodium bicarbonate dissolved in 50 L of water, added to the drum in 10 equal installments over a period of 100 minutes. The leathers were washed in plain water to get chrome-tanned leathers, which were unloaded from drum and piled.

The advantages of the present invention are the following

1. It is a versatile process, which is applicable to both hides and skins.
2. This process effects complete elimination of salt.
3. It ensures that uneven stains do not appear on the leather.
4. The process does not result in harsh grain.
5. It does not adversely affect the physical or chemical characteristics of the tanned stock.
6. The process is cost effective and environmentally friendly.

We claim:

1. A tanning process for making chrome tanned leathers, said process comprising the steps of:

a) conditioning delimed hides or skins to a pH in the range of 5–5.5, b) treating the delimed hides or skins with 6–8% w/w, of a mixture of basic chromium sulfate of basicity ranging 30–45% and alkali metal salt of organic acid up to three carbon chain, for a period of at least 2 Hrs, without addition of water, c) adjusting pH of the contents of step (b) in the range of 4–4.2 by alkalinizing agent, and d) washing the tanned leather with water to obtain chrome tanned leather;

wherein the process does not include pickling or bating the delimed hides or skins.

2. A process as claimed in claim 1 wherein conditioning is carried out by treating the hides or skins with acid selected from lactic acid, acetic acid and formic acid.

3. A process as claimed in claim 1, wherein the basic chromium sulphate used is of basicity 33.3%.

4. A process as claimed in claim 1, wherein the proportion of alkali metal salt of organic acid and basic chromium sulphate used is in the range of 1:7 to 1:10.

5. A process as claimed in claim 1, wherein the alkali metal salt of organic acid used is selected from sodium formate, sodium acetate, sodium carbonate, potassium formate, and potassium acetate.

* * * * *